US009510678B2

(12) United States Patent
Aleisa

(10) Patent No.: US 9,510,678 B2
(45) Date of Patent: Dec. 6, 2016

(54) MODULAR SHELVING

(71) Applicant: Hamad F. H. S. Aleisa, London (GB)

(72) Inventor: Hamad F. H. S. Aleisa, London (GB)

( * ) Notice: Subject to any disclaimer, the term of this patent is extended or adjusted under 35 U.S.C. 154(b) by 0 days.

(21) Appl. No.: 14/490,300

(22) Filed: Sep. 18, 2014

(65) Prior Publication Data

US 2016/0081472 A1 Mar. 24, 2016

(51) Int. Cl.
*A47B 87/02* (2006.01)
*A47B 47/00* (2006.01)

(52) U.S. Cl.
CPC ..... *A47B 87/0292* (2013.01); *A47B 47/0091* (2013.01)

(58) Field of Classification Search
CPC ... A47B 81/06; A47B 87/008; A47B 87/0292; A47B 47/0091; E04B 2/14; E04B 2/16; E04B 2/18; E04B 2002/0206; E04B 2002/0232; E04B 2002/0234
USPC ..... 211/188; 312/111
See application file for complete search history.

(56) References Cited

U.S. PATENT DOCUMENTS

| | | | | |
|---|---|---|---|---|
| 2,351,768 | A * | 6/1944 | Kaping | 52/443 |
| 3,552,817 | A * | 1/1971 | Marcolongo | 312/107 |
| 4,192,562 | A | 3/1980 | Bishoff et al. | |
| 4,253,830 | A * | 3/1981 | Kazen et al. | 433/77 |
| 4,557,094 | A * | 12/1985 | Beliveau | 52/405.4 |
| 5,046,789 | A * | 9/1991 | Lee | 312/108 |
| 5,775,046 | A * | 7/1998 | Fanger et al. | 52/590.1 |
| 6,003,924 | A * | 12/1999 | Nicol | B60R 11/06 296/37.6 |
| 7,100,999 | B2 * | 9/2006 | Stravitz | 312/111 |
| 2002/0070641 | A1 * | 6/2002 | Ragan | 312/111 |
| 2004/0163352 | A1 * | 8/2004 | Ryan | 52/578 |
| 2007/0204548 | A1 * | 9/2007 | Gagne | 52/604 |
| 2013/0208420 | A1 | 8/2013 | Franklin | |
| 2014/0123583 | A1 * | 5/2014 | Arriola Serrano | 52/405.1 |

FOREIGN PATENT DOCUMENTS

| | | | |
|---|---|---|---|
| DE | 202004007209 | U1 | 8/2004 |
| JP | S 557744 | A | 1/1980 |
| KR | 100782634 | B1 | 12/2007 |

OTHER PUBLICATIONS

Kazam!, "Brickbox—shelves, modular libraries," http://www.brickbox.es/en, accessed on Mar. 25, 2016.
Caporaso Design, "More—modular furniture—Caporaso Design," http://www.caporasodesign.it/eng/More.html, last accessed Mar. 25, 2015.
International Search Report and Written Opinion for PCT/US2015/050126, dated Feb. 14, 2016.
Studio Lorier, "Parallel Shelving," http://www.sanderlorier.com/studio/portfolio/parallel-shelving/, last accessed Mar. 31, 2016.

* cited by examiner

*Primary Examiner* — Korie H Chan
(74) *Attorney, Agent, or Firm* — Foley Hoag LLP; Rajesh Vallabh

(57) ABSTRACT

Devices and methods for modular shelving are disclosed.

22 Claims, 17 Drawing Sheets

MODULAR SHELVING

SUMMARY

Devices and methods for modular shelving are disclosed.

DETAILED DESCRIPTION

Described below are modular shelving systems made up generally of identical, or at least similar, units. Benefits of the systems described include, in part, or in various combinations, (1) use of identical units so that in assembling a shelving system, a user need not keep track of different parts, (2) geometric interchangeability such that any desired placement and mating of one piece to another is easily achieved, (3) great flexibility to assemble the units into a wide variety of different shelving arrangements, and (4) a pleasing architectural aesthetic.

Figure 1:
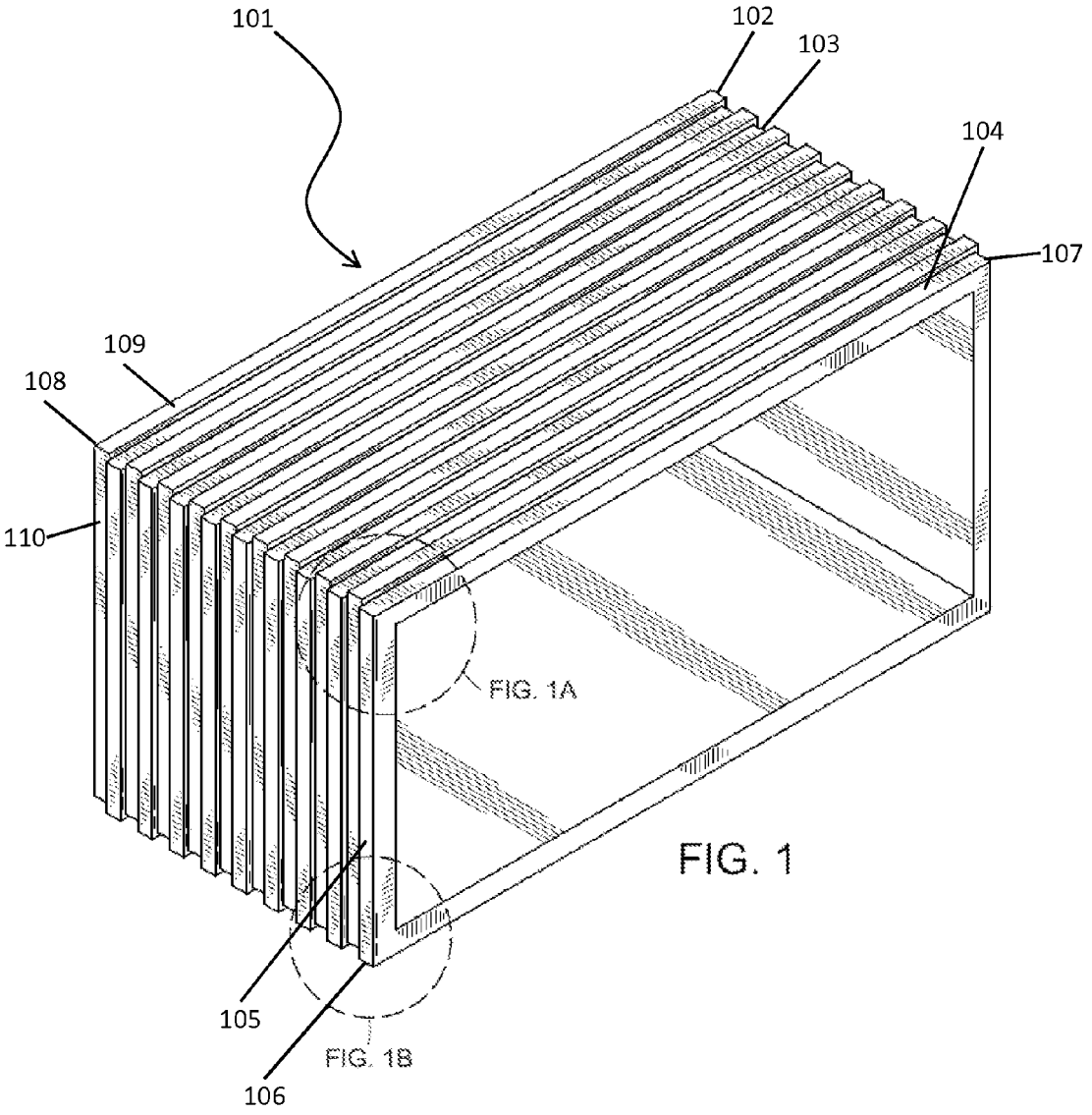
FIG. 1 schematically shows an example of a unit for a modular shelving system in perspective.
Figure 1A:
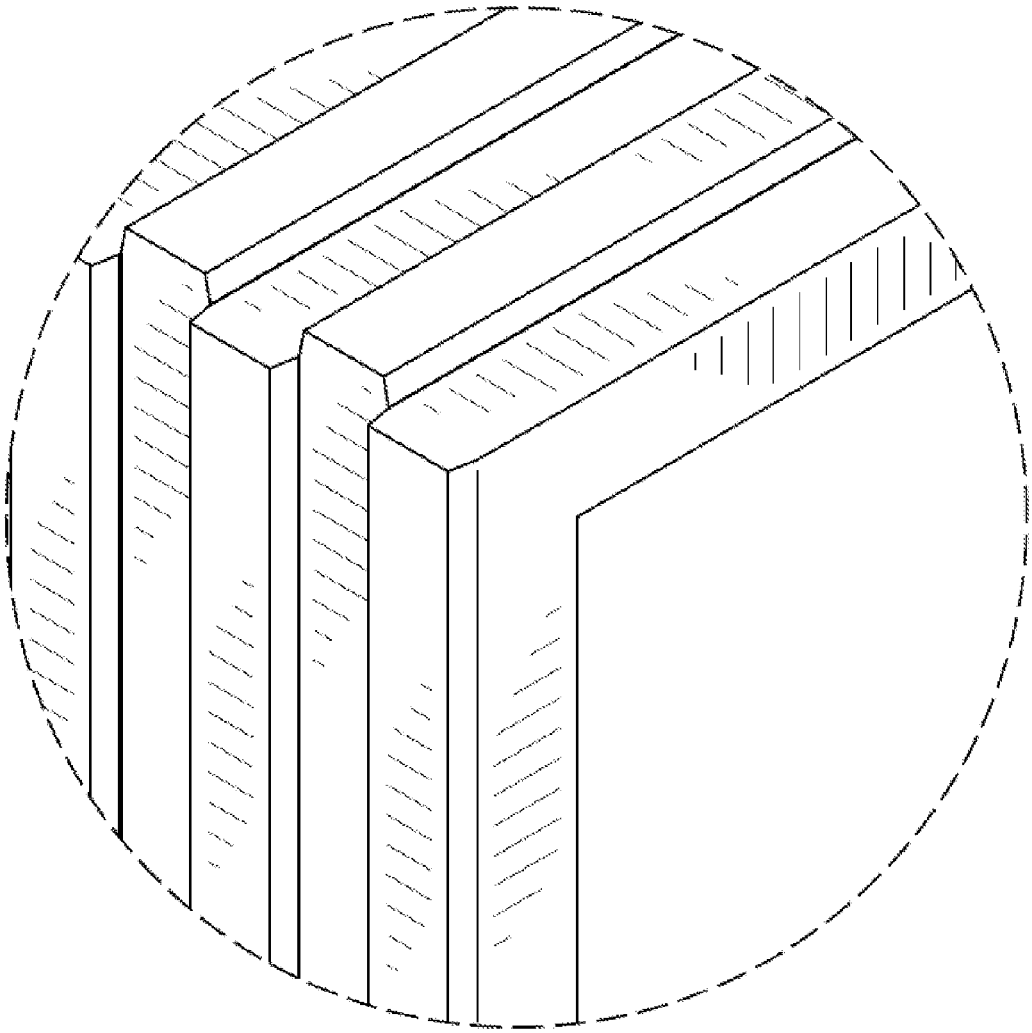
FIGS. 1A and 1B schematically show close-ups of two corners of the unit of FIG. 1.
Figure 1B:
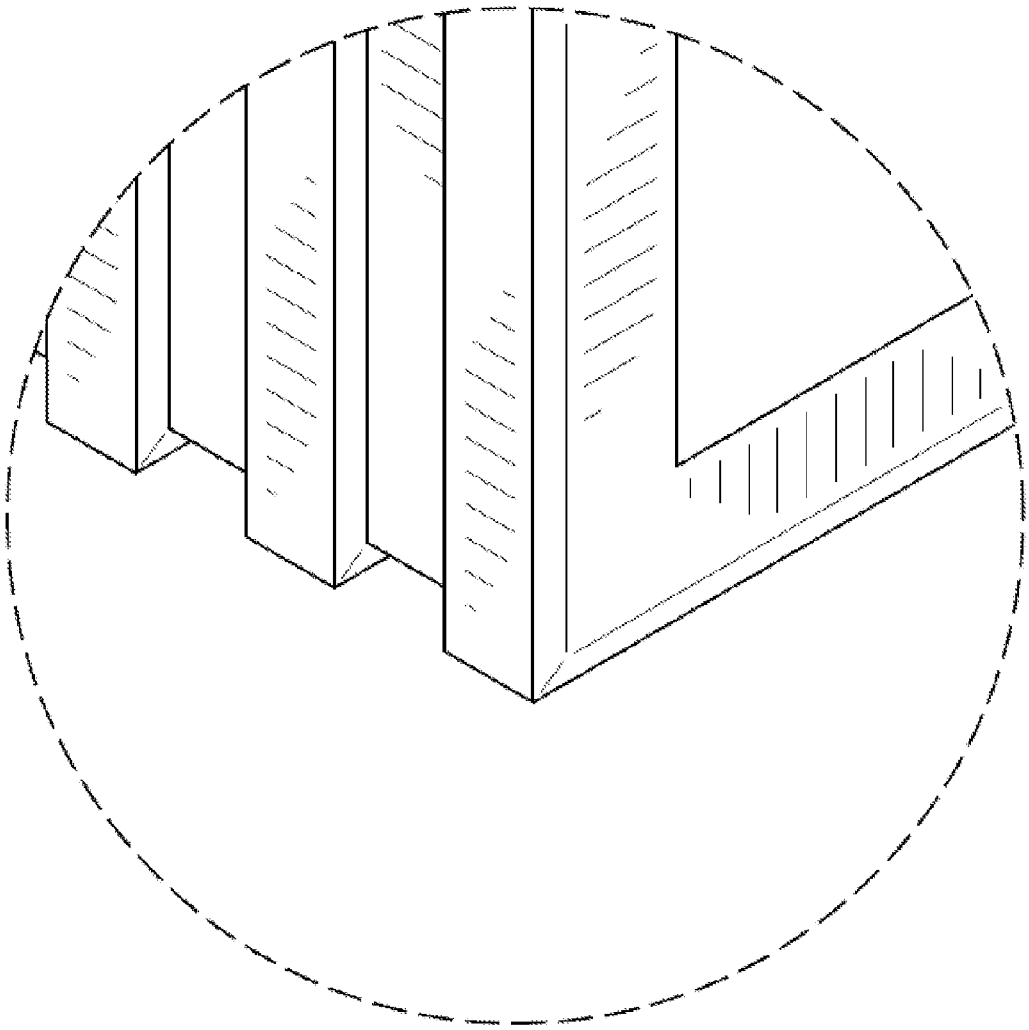

FIG. 1 shows a modular shelving unit 101 formed generally as a rectangular prism having a top, a bottom, and right and left sides. The front and back of the prism are open. The top, bottom, and left and right sides are covered in alternating ridges 102 and grooves 103. The interior of the prism has a generally smooth surface that may be used for shelving. The exterior of the top, bottom, and left and right sides are divided into a series of strips. The front end of the top is depressed, and will for the purposes of this application be considered a groove 104. The front strip is depressed on the right side as well. On the left side, the front strip is a raised ridge 105. The front strip on the bottom is also raised. In this way, at the lower left corner 106, ridge meets ridge, while on the upper right corner 107, groove meets groove. Along the line where the left side meets the bottom, ridge meets ridge and groove meets groove. And similarly along the line where the right side meets the top, groove meets groove and ridge meets ridge. At the upper left corner 108, best seen in the rear-most strip, ridge 109 meets groove 110. All along the line where the left side meets the top, ridge meets groove and groove meets ridge. The same is true of the lower right corner, not visible in the perspective shown in FIG. 1; groove meets ridge and ridge meets groove.

The ridges and grooves are aligned and complementary. As shown in FIG. 1, the front strip of the unit 101 has a groove on its top and a ridge on its bottom. If two such units were stacked, one on top of the other, the ridge on the bottom of the front strip of the upper unit could be aligned with the groove on the top of the front strip of the lower unit. And once the front strips were aligned, the subsequent strips would also mate, ridge in groove and groove about ridge.

Figure 2:
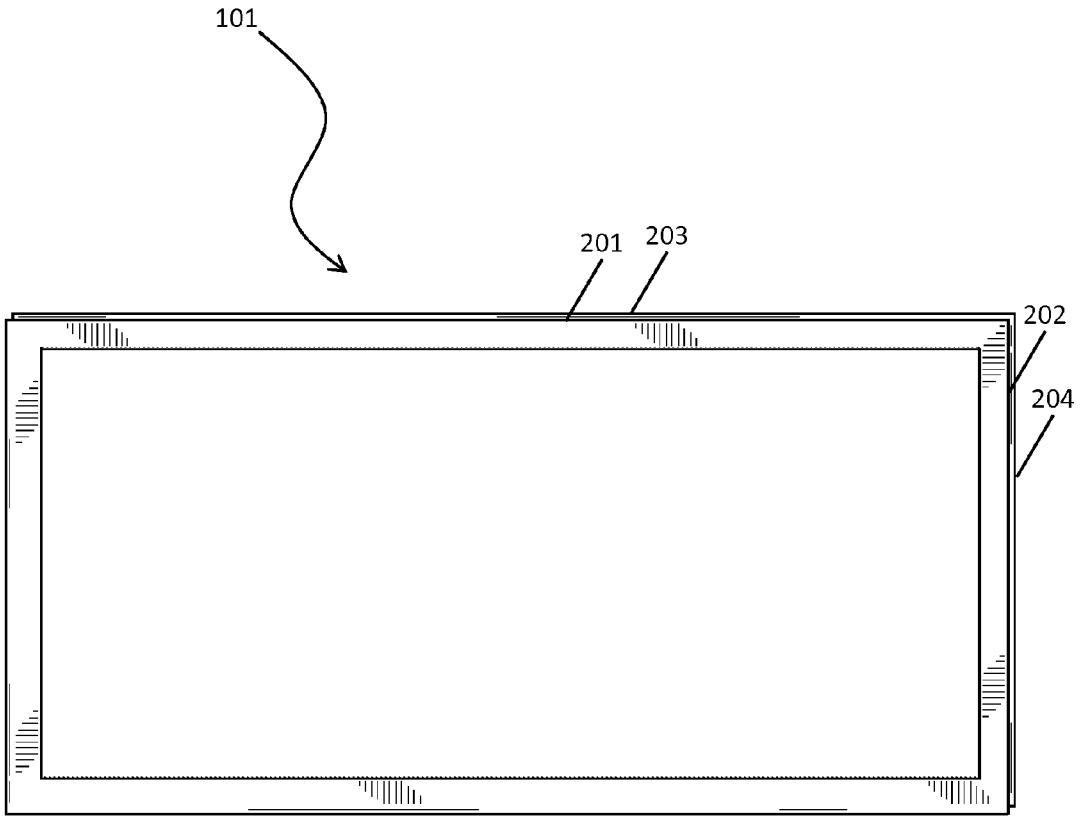
FIG. 2 schematically shows the unit of FIG. 1 from the front.

FIG. 2 shows the unit 101 from the front with the depressed grooves 201, 202 on the top and right of the front strip visible and the ridges 203, 204 just behind also visible.

Figure 3:
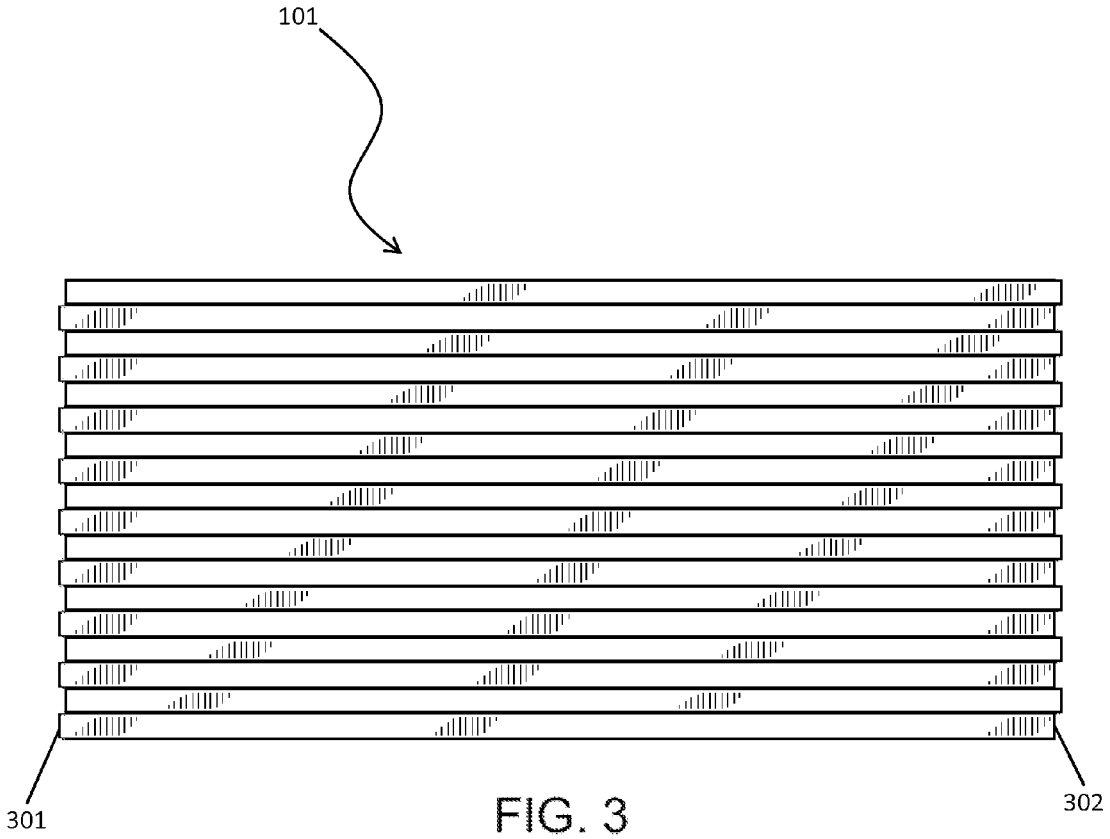
FIG. 3 schematically shows the unit of FIG. 1 from above.

FIG. 3 shows the unit 101 from above with the front groove 302 along the right side and the front ridge 301 along the left side visible.

Figure 4:
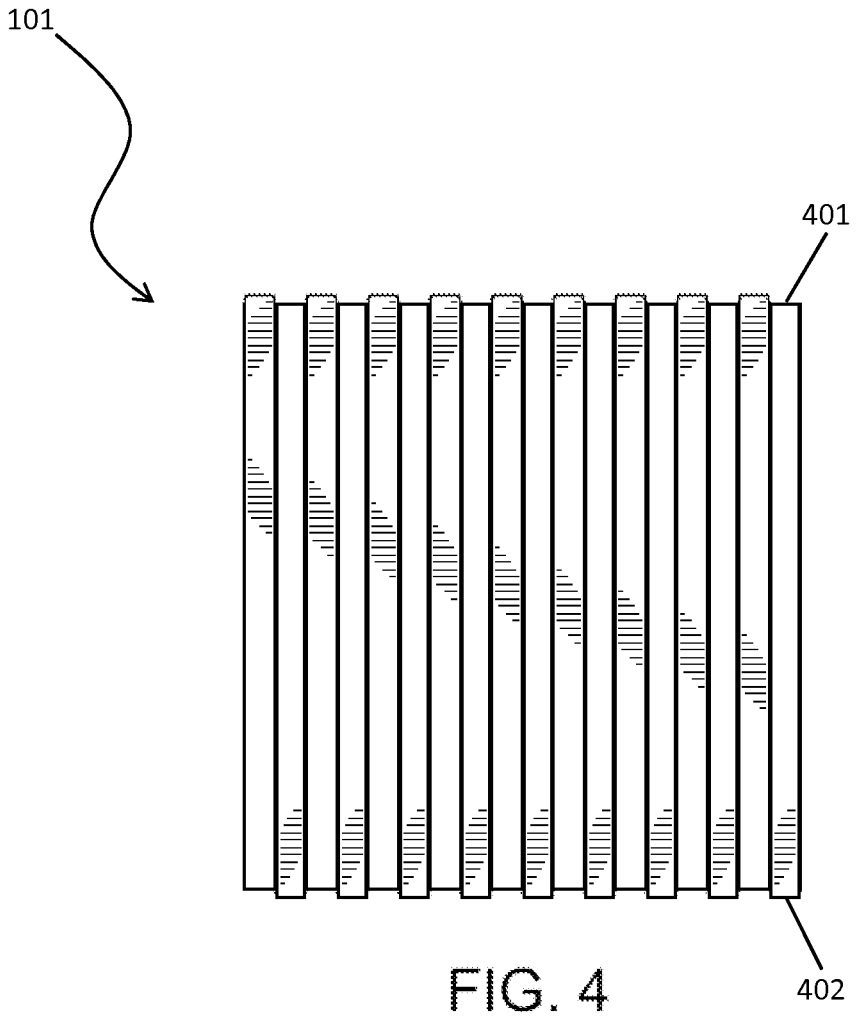
FIG. 4 schematically shows the unit of FIG. 1 from the left.

FIG. 4 shows the unit 101 from the left, with the front groove 401 on the top visible, and the front ridge 402 on the bottom visible.

Figure 5:
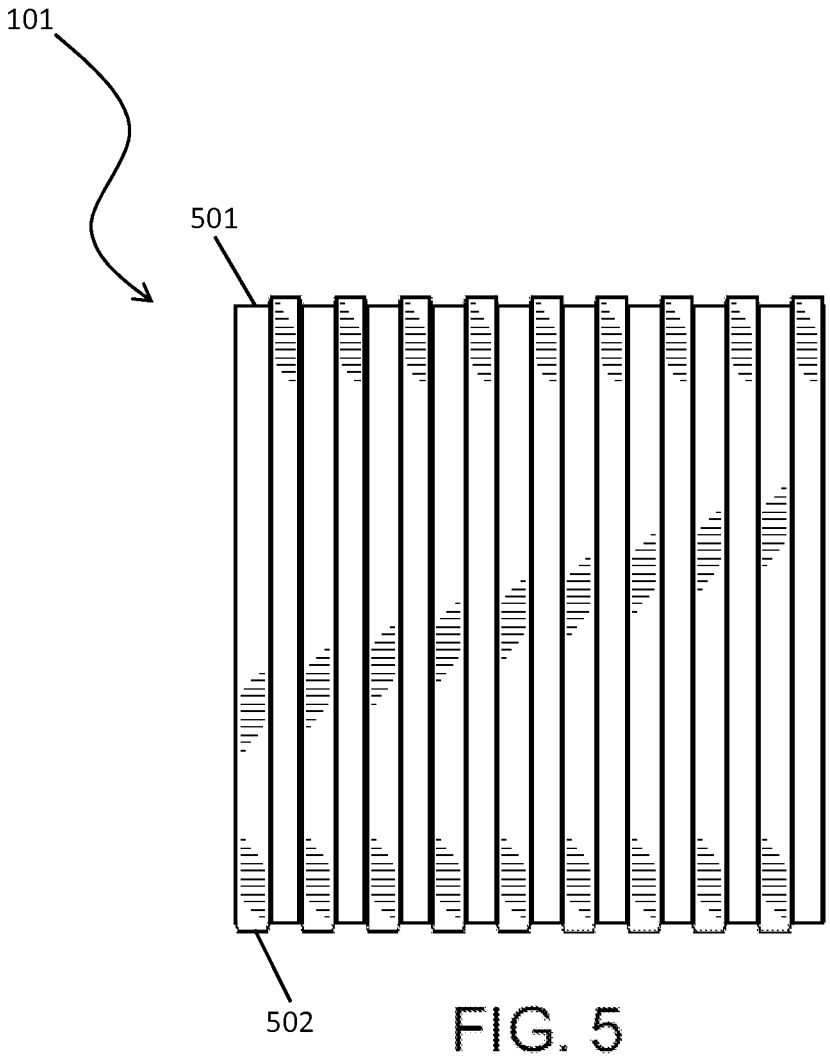
FIG. 5 schematically shows the unit of FIG. 1 from the right.

FIG. 5 shows the unit 101 from the right, with the front groove 501 on the top visible, and the front ridge 502 on the bottom visible.

Figure 6:
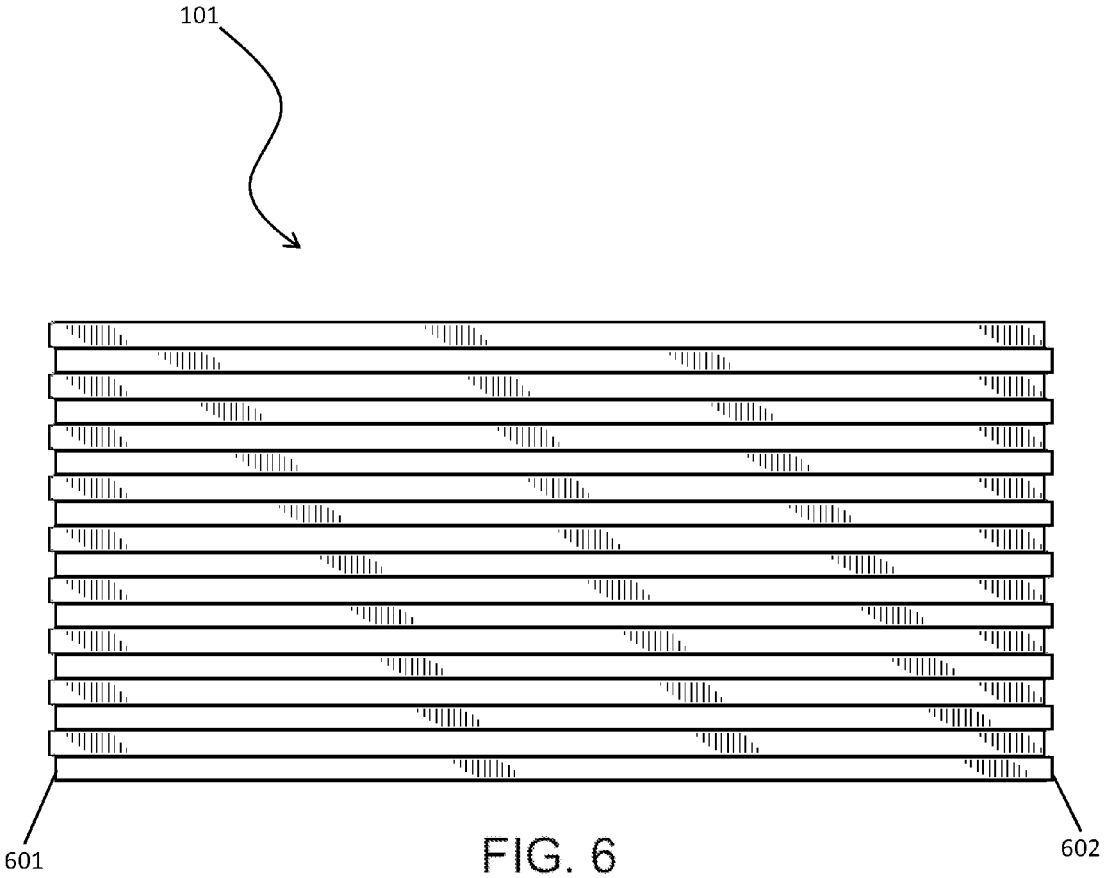
FIG. 6 schematically shows the unit of FIG. 1 from below.

FIG. 6 shows the unit 101 from below with the front groove 602 along the right side and the front ridge 601 along the left side visible.

Figure 7:
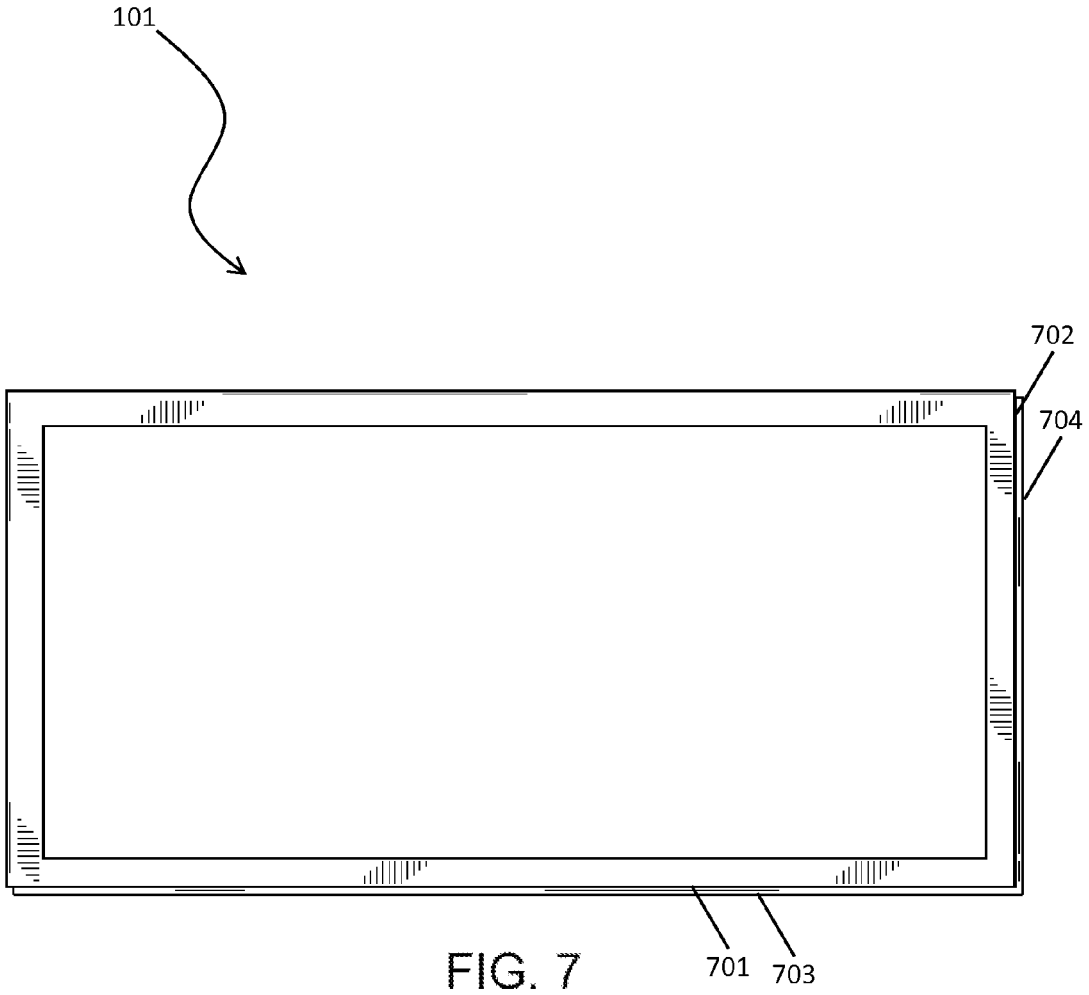
FIG. 7 schematically shows the unit of FIG. 1 from the rear.

FIG. 7 shows the unit 101 from the rear with the depressed grooves 701, 702 on the bottom and left of the rear strip visible, and the ridges 703, 704 just behind also visible.

Figure 8:
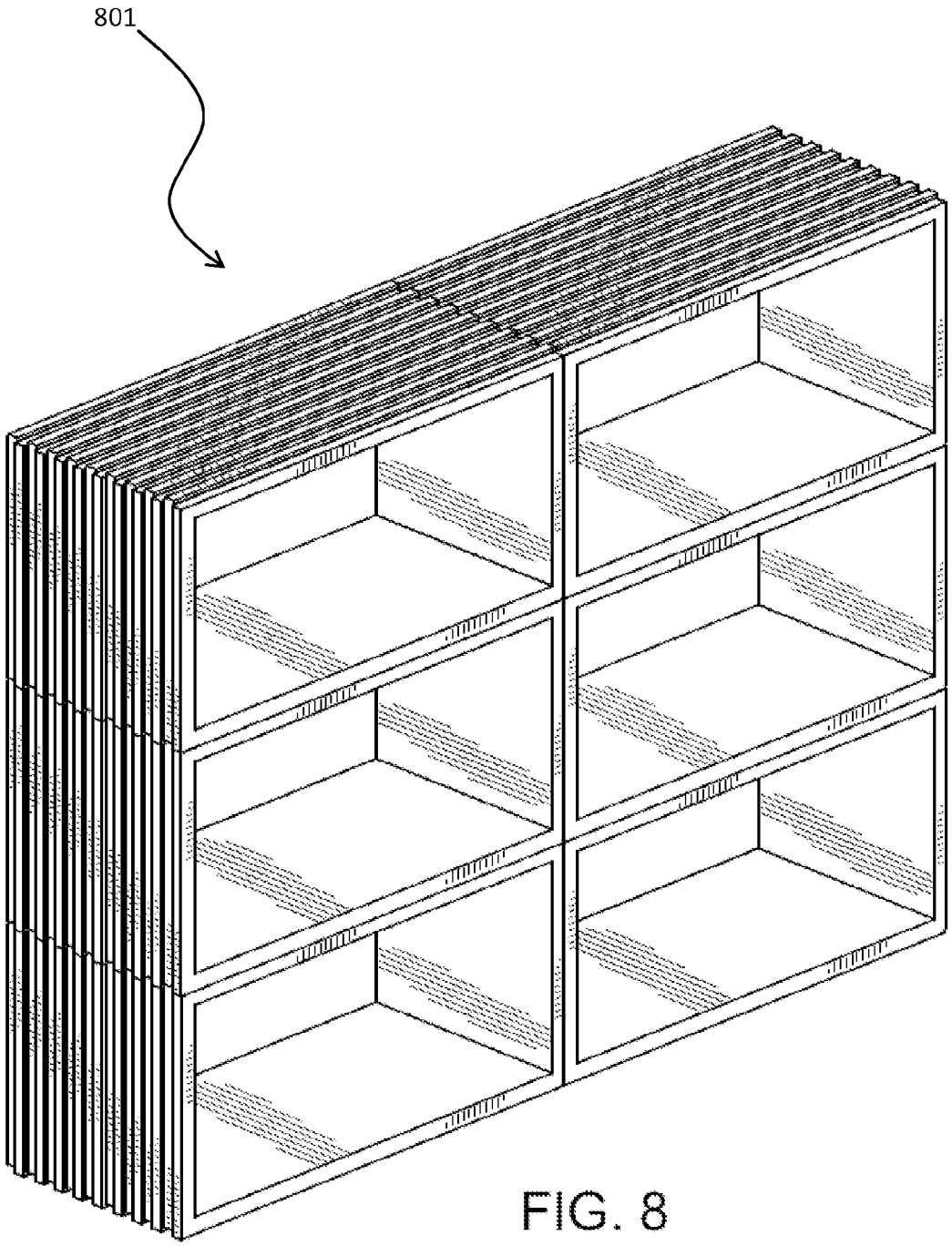
FIGS. 8-10 schematically show several of the units shown in FIG. 1 assembled in various arrangements.

FIG. 8 shows one arrangement 801 of six units, all identical to the unit 101 shown in FIGS. 1-7. The arrangement 801 shows the units set up as an ordinary shelf, with six separated shelves in two columns and three rows. The front surfaces of all six units are aligned. In each case, the lower front ridge of each unit lines up with the upper front groove of the unit below it, and all the ridges and grooves on the top and bottom surfaces correspondingly mate with one another. Likewise, the right front groove of each unit in the left column aligns with the left front ridge of the corresponding unit in the right column, and the rest of the left and right side surfaces correspondingly mate with one another as well. The outer surfaces of the units, because they are not mated to any additional units, form an attractive ornamental design of alternating ridges and grooves.

Figure 19A:
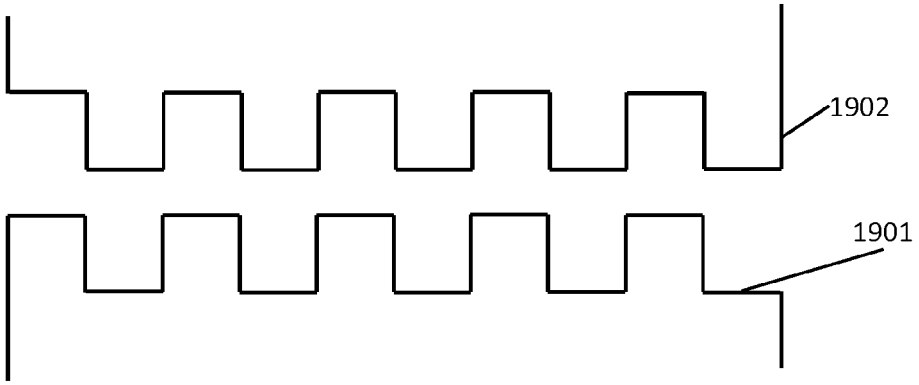
FIGS. 19A, B and C schematically show a different ways of arranging a pair of modular shelving units.

FIG. 19A schematically shows a close-up how the complementary ridge and grooves line up when the units are aligned with their front edges all in a single vertical plane, as shown in FIG. 8. In this case, the upper front groove 1901 of the lower unit lines up with the lower front ridge 1902 of the upper unit. The remaining ridges and grooves naturally line up as well, and so do the rear edges.

Figure 9:
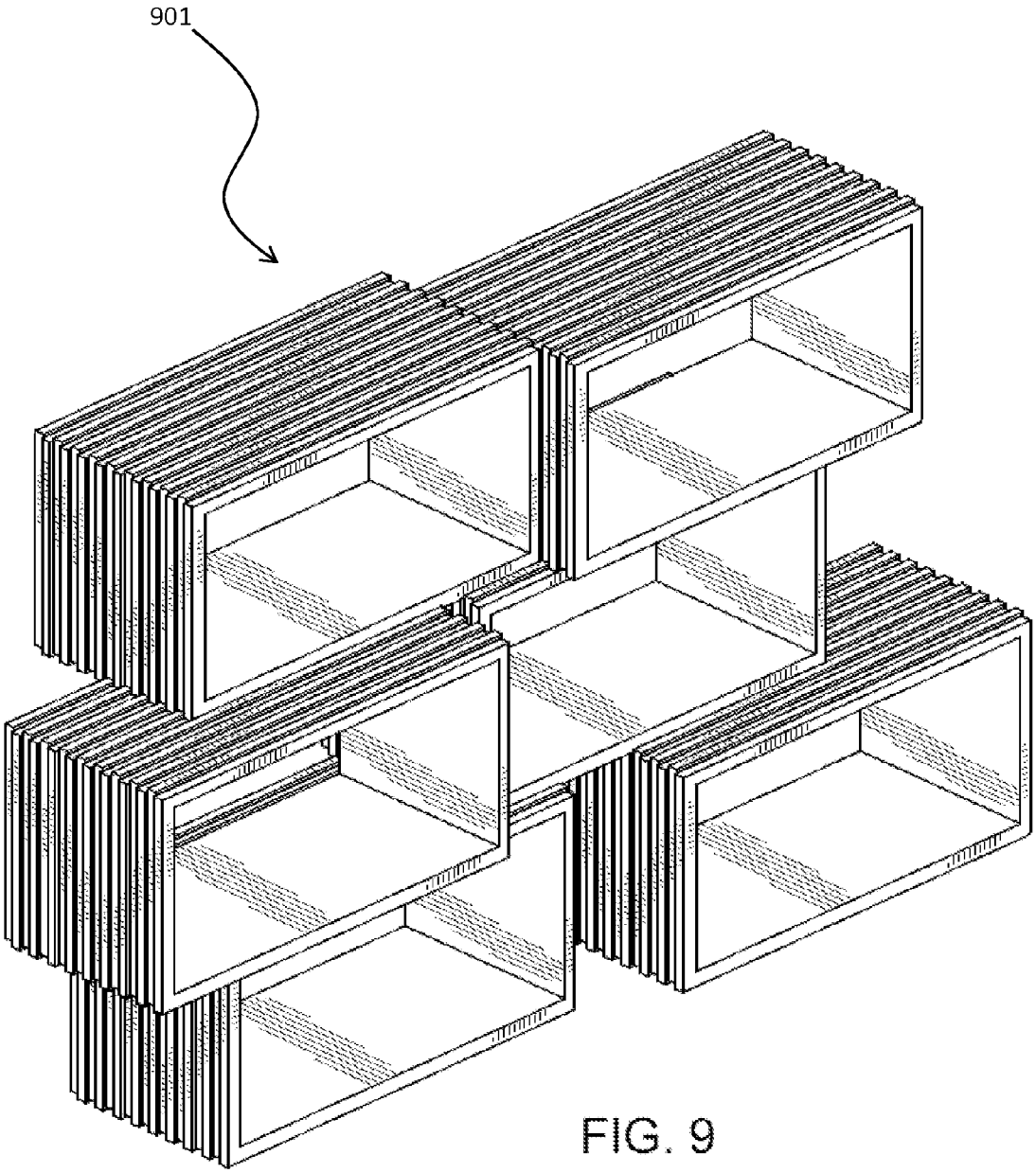

FIG. 9 shows another possible arrangement 901 of the same six identical units. In this case, the units are staggered both forward-backward and also left-right to create a more irregular arrangement. The units need not all be aligned in order to stack in a complementary mated arrangement. Because all the ridges are identical and all the grooves are identical, the units can be staggered and still have ridges on one surface mated with grooves on the opposing surface.

Figure 19B:
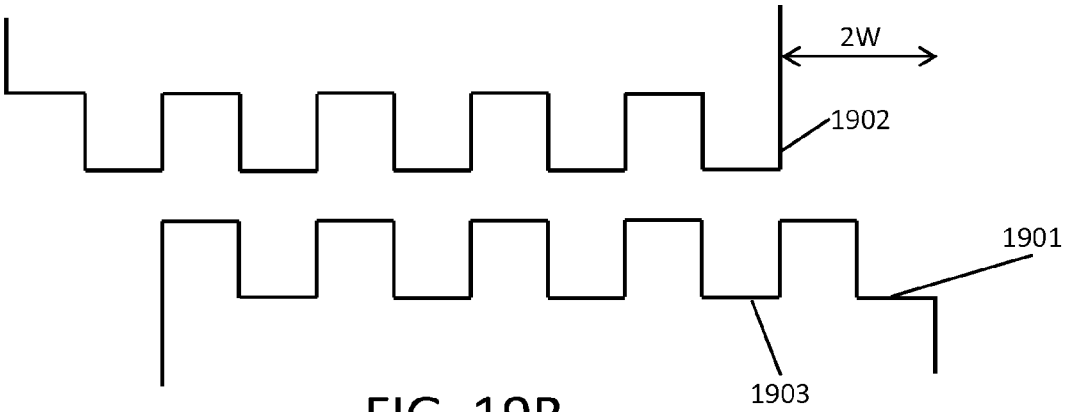
Figure 19C:
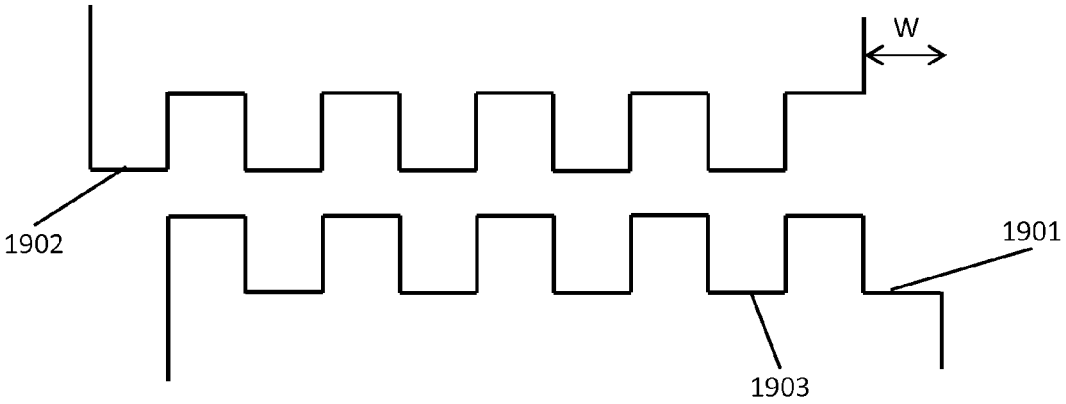

The complementary arrangement of ridges and grooves allows for a particularly large degree of flexibility in stacked arrangements, even when all units are identical. For example, as shown in FIG. 19B, the aligned arrangement of FIG. 19A can be altered by simply moving the upper unit backward by the width of two ridges (2W) so that the lower front ridge 1902 of the upper unit lines up with the upper second groove 1903 of the lower block rather than its upper front groove 1901. If the user prefers to offset the units by the width of a single ridge (W), he cannot simply shift the upper unit backward by that distance from the arrangement of FIG. 19A. If he did, ridges would align with ridges and grooves with grooves, and the surfaces would not mate. Instead, the user can rotate the upper unit 180 degrees about the vertical axis, exchanging front for back so that what was the front lower ridge 1902 is now positioned at the rear. In this position, ridge and grooves will mate properly when the units are offset by the width of a single ridge. Alternatively, the user could achieve the same result by rotating the upper unit 180 degrees about the horizontal axis that passes through the centers of the side panels. As another alternative, the user could achieve an equivalent results by rotating the upper unit 180 degrees about the horizontal axis that passes through the centers of the open front and back of the upper unit, turning the upper unit upside down instead of front to back.

This arrangement of top grooves aligned with bottom ridges, and bottom grooves aligned with top ridges, allows both for great flexibility in how the units can be assembled, and also for great ease of use. If a user finds that two units are not properly mating in the positions where he wants the units, he can simply turn one unit around by 180 degrees and the units will slide together.

Figure 10:
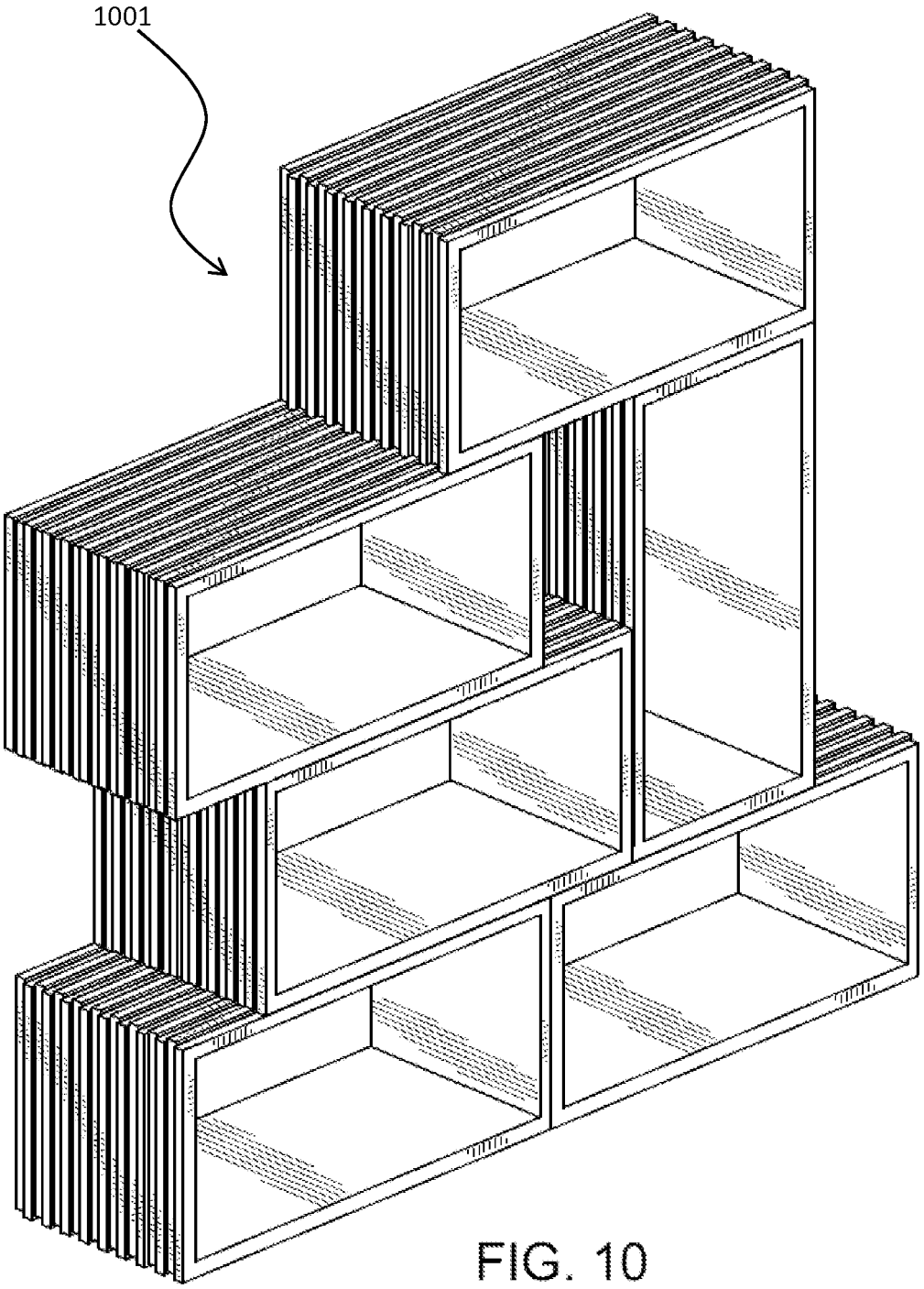

FIG. 10 illustrates arrangement 1001 in which the units can be stacked. In addition to offsetting the units forward-backward or right-left, one or more units may be rotated 90 degrees in a vertical arrangement. This works best where the length of a unit and its height are an integral multiple of one another. As shown in FIGS. 1-10, the units are exactly twice as long as they are high, so that when one unit is turned on its side, as in FIG. 10, it takes on a height equal to the height of two stacked units in the horizontal position. Alternatively, units could have lengths equal to a variety of multiples of their heights, e.g., 2, 3, 4, 5, 3/2, 4/3, etc. Where the length is a small integral multiple, or a simple rational multiple of the height, stacking will be simplest.

Figure 11:
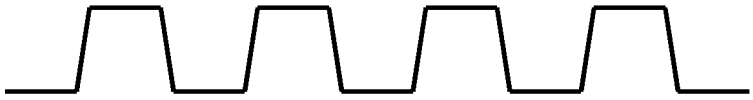
FIGS. 11-16 schematically show several different embodiments for the surface of a unit for a modular shelving system.

FIGS. 11-16 show a variety of different shapes for the ridges and grooves. FIG. 11 shows a version of the preferred embodiment in which the tops and bottoms of the ridges and grooves are flat and parallel, while the interconnecting walls are slightly sloped. Said another way, the cross-sectional shape of both the ridges and grooves is an isosceles trapezoid. By experimentation, the inventor has found that one advantageous arrangement is to have the top of each ridge be about 16 mm wide, the bottom of each groove be about 18 mm wide, the depth of the vertical distance from ridge to groove be about 5 mm, and the horizontal offset from ridge to groove be about 1 mm so that the sloped portion from ridge to groove is about 10 degrees off of vertical.

Many other angles and measurements are possible as well. For example the ridges and grooves could widths that are equal, about equal, within 10% of being equal, within a factor of 2 of being equal, etc. The sloped portion from ridge to groove could be, for example, 1, 2, 3, 5, 7, 10, 15, 20, 30, 45, 60, 75 or 80 degrees from vertical. The ridge and groove widths could be, for example, 1, 3, 5, 7, 10, 15, 20, 25, 30, 40, 50, or 60 mm.

Figure 12:
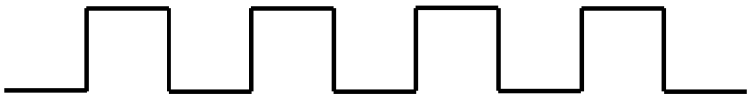
Figure 13:
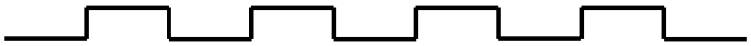
Figure 14:
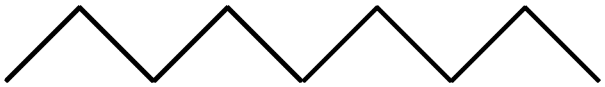
Figure 15:
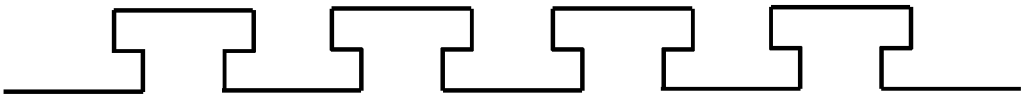

FIG. 12 shows another embodiment in which the ridges and grooves are precisely square-wave shaped with the interconnecting walls between ridge and grooves perpendicular to the upper and lower faces of the ridges and grooves. FIG. 13 shows a similar arrangement where the ridges and grooves have a non-square, rectangular cross-sectional shape. FIG. 14 shows a triangular cross-sectional shape. As shown, the triangle is a right, isosceles triangle, but other triangles are possible as well, for example an arrangement that looks like a sawtooth wave, with a vertical walls connected by sloped walls. FIG. 15 shows ridges and grooves with a t-shaped cross-section. Unlike the other examples, these actually interlock and cannot be mated simply by lowering one block onto the other, but rather must be slid together. This makes for much less flexible arrangements and more cumbersome assembly.

Figure 16:
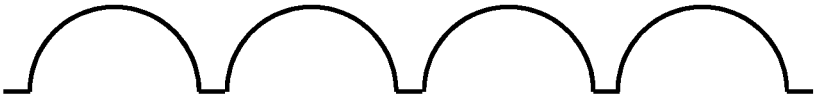

FIG. 16 shows an embodiment in which the ridges are semi-circular and the grooves are roughly cusp-shaped. There are many such shapes in which the ridges and grooves are not the same shape. In such embodiments, opposing faces of adjacent units will partially, but not entirely, mate.

Figure 17:
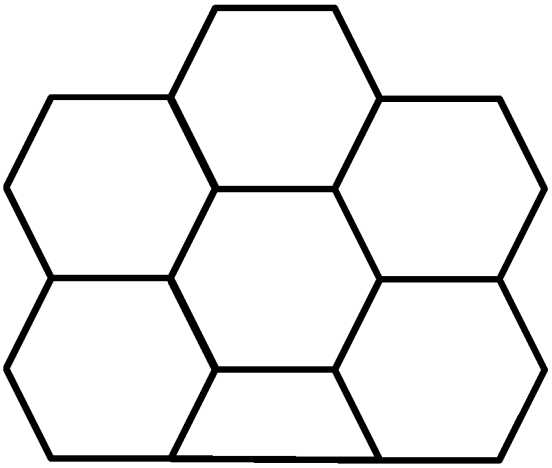
FIGS. 17-18 schematically show an examples of a different unit for a modular shelving systems using modular units of different shapes.

FIG. 17 shows a different embodiment in which the units are hexagonal prisms rather than rectangular prisms. There are several ways of arranging such hexagonal units. Each hexagonal unit may have the same ridge-groove pattern on all three downward facing sides, for example a lower front ridge, while the upper three sides all have an upper front groove. Alternatively, the groove-ridge pattern could alternate sides. In this embodiment, a hexagonal unit might have a front ridge on the horizontal downward-facing side, and the two diagonal upward facing sides, while having a front groove on the horizontal upward-facing side and the two diagonal downward-facing sides. Additionally, such a system might also include a half-hexagonal unit as shown in the center-bottom of the assembly in FIG. 17.

Figure 18:
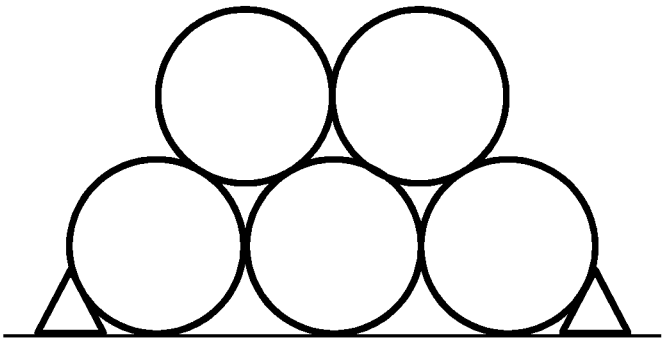

FIG. 18 shows yet another embodiment in which, rather than polygonal prisms, the units are cylindrical. In cylindrical embodiments, the units could have ridge-groove patterns similar to the ridge-groove patterns in the hexagonal embodiments, since circles naturally assume a hexagonal packing arrangement, as shown in FIG. 18. The system of FIG. 18 might also benefit from the addition of grooved and ridged chocks that could be positioned to the left and right of the cylinders to keep them from rolling. The chocks could have any appropriate shape.

Figure 20:
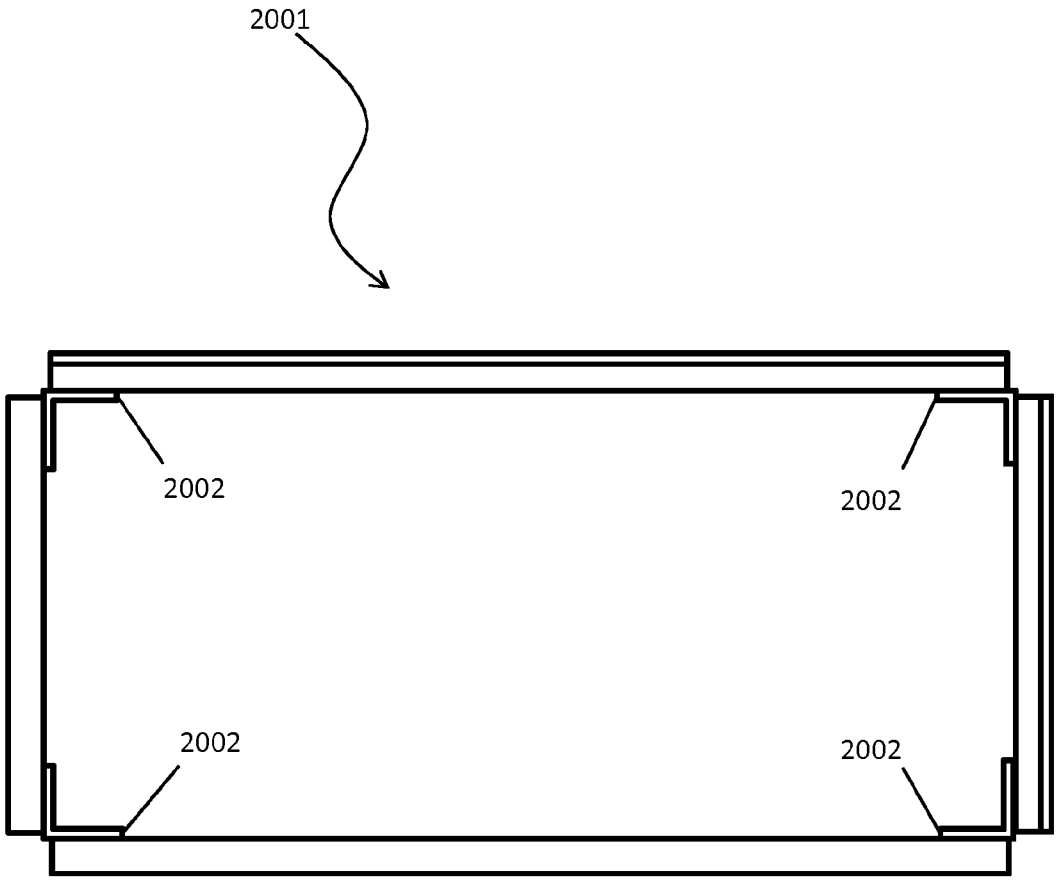
FIGS. 20 and 21 schematically show an alternative design for a modular shelving unit.

FIG. 20 schematically shows a modular shelving unit 2001. Similar to the unit shown in FIGS. 1-7, this unit 2001 includes top, bottom, right and left sides with alternating grooves and ridges, with the same relationship between ridge and groove patterns on the left and right, and top and bottom sides. But in this case, the sides are held together by internal right angle brackets 2002. As shown, the right angle brackets 2002 are proud of the internal surfaces of the unit, but they could be recessed or countersunk to keep the internal surface smooth. A wide variety of such brackets or fasteners could be used in this way to secure the sides to each other. The sides could be secured to one another by one or multiple fasteners. Although the appearance of the unit 2001 is somewhat different than the unit shown in FIGS. 1-7, the functionality is the same because the ridge and groove patterns on the sides are the same.

Figure 21:
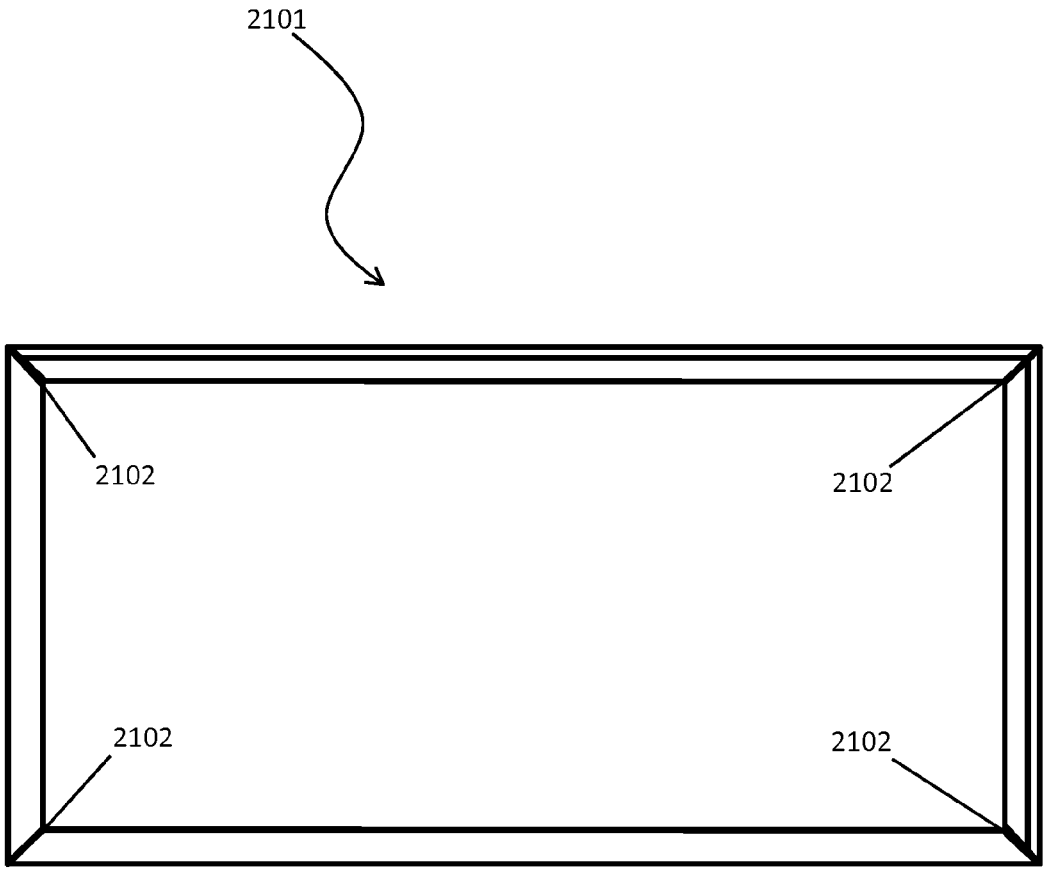

FIG. 21 schematically shows a modular shelving unit 2101 similar to those of FIGS. 1-7 and 20. As shown, the top, bottom, left and right sides are joined to each other at their corners with miters 2102. The corners can be fastened with mechanical fasteners, such as nails or with screws, or adhesives. A singular simple miter may suffice at each corner, or a complex miter may be used in some cases.

Each of the four sides can be a separate piece. Also, one or more sides can be made up of multiple pieces. For example, where the ratio of the lengths of the sides is 2:1, the short sides can each be made of a single piece, while the longer sides can be made of two pieces, each identical to the short sides. Embodiments whose side lengths are other whole number ratios can similarly include sides made out of a whole number of identical pieces.

In embodiments in which a single unit is formed of multiple generally planar pieces, the unit can be assembled by a consumer and sold in a flat-pack format, for example, with mechanical fasteners in the form of a kit. The kit could include the pieces necessary to build a single unit, or multiple identical units. The kit could include a plurality of identically sized pieces so that the user has the option of choosing the ratio of height to breadth for each unit the user constructs, e.g., 2:1, 3:1, 3:2, etc. The user might choose to construct a collection of identical units, or a collection of units with differing ratios and sizes.

In any embodiment described herein, a wide variety of materials can be used to construct the units, including wood, plastics, ceramics, metals, starch/cellulose, etc. The units can be made from a single integral piece, or assembled from multiple pieces. Each piece may be integral or may itself be assembled from different subpieces, for example a wood piece may comprise a generally planar substrate to which ridges are added on one side. Each unit or piece or subpiece can be machined, molded, 3-d printed, or otherwise formed by known processes.

I claim:

1. A modular shelving system comprising:

a plurality of shelving units;

wherein each shelving unit includes at least two pairs of parallel opposite sides, each of said sides being connected at opposite ends thereof to other sides such that the sides together define and surround an accessible interior space accessible through at least one open end, said sides having a plurality of adjacent parallel strip elements on their exteriors, each of said plurality of adjacent parallel strip elements completely circumscribing the interior space, said plurality of adjacent parallel strip elements forming alternating ridges and grooves on each side sized and shaped so that each ridge of each shelving unit is capable of mating with any groove of any other shelving unit, wherein for each pair of parallel opposite sides each strip element forms a ridge on one side and a groove on the opposite side; and wherein each shelving unit has at least one ridge mated with a groove of another shelving unit.

2. The system of claim 1 wherein each unit has exactly four sides.

3. The system of claim 2 wherein each unit forms substantially a rectangular prism.

4. The system of claim 3 wherein one pair of parallel sides is about twice as long as the other pair of parallel sides.

5. The system of claim 4 wherein a ridge on the first side of one shelving unit is mated with a groove on the second side of another shelving unit.

6. The system of claim 1 wherein each unit is made of wood.

7. The system of claim 1 wherein each side of each unit is formed from a single integral piece.

8. The system of claim 1 wherein each unit is formed of exactly four sides joined together.

9. The system of claim 1 wherein the number of ridges on each side of each unit is equal to the number of grooves on each side of each unit.

10. The system of claim 1 wherein the cross-sectional shape of each ridge is either rectangular, trapezoidal or triangular.

11. A modular shelving system comprising:

a plurality of shelving units that can be assembled together in various changeable configurations;

wherein each shelving unit includes at least two pairs of parallel opposite sides, each of said sides being connected at opposite ends thereof to other sides such that the sides together define and surround an accessible interior space accessible through at least one open end, each shelving unit including a plurality of adjacent parallel strip elements on an exterior of the shelving unit each completely circumscribing the interior space, said plurality of parallel strip elements forming alternating ridges and grooves sized and shaped so that each ridge of each unit is capable of mating with any groove of any other unit, wherein for each pair of parallel opposite sides each strip element forms a ridge on one side and a groove on the opposite side; and wherein each shelving unit has at least one ridge mated with a groove of another unit.

12. The system of claim 11 wherein each unit has exactly four sides.

13. The system of claim 12 wherein each unit forms substantially a rectangular prism.

14. The system of claim 13 wherein one pair of parallel sides is about twice as long as the other pair of parallel sides.

15. The system of claim 14 wherein a ridge on the first side of one shelving unit is mated with a groove on the second side of another shelving unit.

16. The system of claim 11 wherein each unit is made of wood.

17. The system of claim 11 wherein each side of each unit is formed from a single integral piece.

18. The system of claim 11 wherein each unit is formed of exactly four sides joined together.

19. The system of claim 11 wherein the number of ridges on each side of each unit is equal to the number of grooves on each side of each unit.

20. The system of claim 11 wherein the at least two pairs of parallel sides also define an open rear in a rear plane, the rear plane being parallel to the front plane.

21. The system of claim 1, wherein each of the sides has a smooth inner surface facing the interior space.

22. The system of claim 11, wherein each of the sides has a smooth inner surface facing the interior space.

* * * * *